US011624180B1

(12) United States Patent
Beaver, Jr. et al.

(10) Patent No.: US 11,624,180 B1
(45) **Date of Patent: *Apr. 11, 2023**

(54) DRAIN PROTECTOR

(71) Applicant: HalenHardy LLC, Bellwood, PA (US)

(72) Inventors: Donald L. Beaver, Jr., Bellwood, PA (US); Joshua D. Beaver, Bellwood, PA (US); Troy L. Beaver, Bellwood, PA (US); Patrick E. Healy, Gallitzin, PA (US); Katlyn Palmer, Philadelphia, PA (US); Brandon W. Guida, Bellwood, PA (US)

(73) Assignee: HALENHARDY LLC, Bellwood, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/477,152

(22) Filed: Sep. 16, 2021

Related U.S. Application Data

(63) Continuation of application No. 16/825,283, filed on Mar. 20, 2020, now Pat. No. 11,124,960.

(60) Provisional application No. 62/822,445, filed on Mar. 22, 2019.

(51) Int. Cl.

| | |
|---|---|
| ***E03F 5/06*** | (2006.01) |
| ***E03F 5/14*** | (2006.01) |
| ***E03F 1/00*** | (2006.01) |
| ***E03F 5/04*** | (2006.01) |

(52) U.S. Cl.
CPC ..... *E03F 5/14* (2013.01); *E03F 1/005* (2013.01); *E03F 5/0404* (2013.01); *E03F 5/06* (2013.01); *E03F 2005/061* (2013.01)

(58) Field of Classification Search
CPC ..... E03F 5/0404; E03F 5/06
USPC ..... 210/163, 164, 170.03, 747.3
See application file for complete search history.

(56) References Cited

U.S. PATENT DOCUMENTS

| | | | |
|---|---|---|---|
| 3,539,013 | A | 11/1970 | Smith |
| 3,804,661 | A | 4/1974 | Muntzer et al. |
| 4,199,447 | A | 4/1980 | Chambers et al. |
| 5,020,638 | A | 6/1991 | Smith |
| 5,165,821 | A | 11/1992 | Fischer et al. |

(Continued)

FOREIGN PATENT DOCUMENTS

| | | |
|---|---|---|
| GB | 2428032 A | 1/2007 |
| WO | 2000049893 | 8/2000 |

OTHER PUBLICATIONS

"Over-the-Drain Debris Filter;" https://www.newpig.com/over-the-drain-debris-filter/p/FLT699?couponCode=PLAHOOD; Mar. 22, 2019.

(Continued)

*Primary Examiner* — Christopher Upton
(74) *Attorney, Agent, or Firm* — Fox Rothschild LLP

(57) ABSTRACT

A drain protector having a flexible adsorbent pad, a raised insert, and a cover is described. The pad and the insert each includes aligned apertures. The raised insert is positioned over the flexible adsorbent pad or within the aperture of the flexible adsorbent pad. The cover is connected to the flexible adsorbent pad, a raised insert, forming a space over the insert. The drain protector is made from adsorbent material for blocking sediment, collecting contaminants and filtering water into a drain. The cover of the drain protector reinforces the sheet and insert to protect against damage from traffic over the drain protector.

17 Claims, 6 Drawing Sheets

(56) References Cited

U.S. PATENT DOCUMENTS

| | | | |
|---|---|---|---|
| 5,948,250 | A | 9/1999 | Middleton |
| 6,485,639 | B1 | 11/2002 | Gannon et al. |
| 6,562,938 | B2 | 5/2003 | Haile et al. |
| 6,808,623 | B2 | 10/2004 | Harris et al. |
| 7,070,691 | B2 | 7/2006 | Lindemulder |
| 7,131,787 | B2 | 11/2006 | McGinn |
| 7,316,834 | B2 | 1/2008 | Hernandez |
| 7,357,861 | B2 | 4/2008 | Kelley et al. |
| 7,955,030 | B2 | 6/2011 | McGinn et al. |
| 8,512,552 | B1 | 8/2013 | Rossi |
| 10,407,891 | B1 | 9/2019 | Sanguinetti |
| 11,124,960 | B1 * | 9/2021 | Beaver, Jr. ..... E03F 5/06 |
| 2007/0295652 | A1 | 12/2007 | Kent |
| 2008/0296211 | A1 | 12/2008 | Swan |
| 2009/0279954 | A1 | 11/2009 | Griffith et al. |
| 2011/0049027 | A1 | 3/2011 | Rueda |
| 2012/0241460 | A1 | 9/2012 | Ibbotson |
| 2014/0048465 | A1 | 2/2014 | D'Andreta et al. |
| 2017/0130414 | A1 | 5/2017 | Joiner et al. |
| 2018/0230688 | A1 | 8/2018 | Morris |
| 2019/0040618 | A1 | 2/2019 | Zock et al. |

OTHER PUBLICATIONS

"Upstate Innovators are Taking the Lead in Eco-Innovation" by Guest Contributor; Mar. 15, 2017.

"Storm Water Products;" Construction Site Product, Storm Water Construction; https://jrhoe.com/stormwaterproducts.html; Mar. 22, 2019.

"Stormwater Solutions & Management Products Inlet Guards, Drain Covers, Filter Socks and More;" GEI Works; https://www.erosionpollution.com/stormwatersolutions.html; Mar. 22, 2019.

Ertec Enviommental Systems; https://ertecsystems.com/Products/Top-Guard -- Drain-Inlet-Protection/GR8-Guard . . . ; Mar. 22, 2019.

"Drain Protection & Stormwater Management Storm Drain Filters;" https://www/newpig.com/storm-drain-filters/c/5060; Feb. 8, 2019.

ACF Environmental; "Sedibag Reusable Inlet Protection—Sedibag Catch-Basin Filter Removes Sediment, Trash and Debris from Stormwater Entering a Catch-Basin".

Monarch Green Inc. "Flex Booms Oilinator Oil Only 6×10 Flexible Flat Boom;" https:monarchgreen.com/products/flex-booms; Feb. 7, 2019.

"Pig Flat Absorbent Sock;" https://www.newpig.com/pig-flat-absorbent-sock/p/PIG100?searchTerm=Low-Profile+Flat+Absorbent+Sock+PID+100; Feb. 7, 2019.

"Pig Oily-Only Spaghetti Boom;" https://www.newpig.com/pig-oil-only-spaghetti-boom/p/BOM204?searchTerm=Spaghetti+Booms; Feb. 7, 2019.

"Specially Designed to Contain and Absorb Thick Oils on Water; Description specifications".

* cited by examiner

DRAIN PROTECTOR

RELATED APPLICATIONS AND CLAIM OF PRIORITY

The patent application claims priority to U.S. patent application Ser. No. 16/825,283, filed Mar. 20, 2020, which in turn claims priority to U.S. Provisional Patent Application No. 62/822,445, filed Mar. 22, 2019. The disclosure of each priority application is fully incorporated into this document by reference.

BACKGROUND

The disclosure relates generally to drain protectors, and in particular to reinforced drain protectors that are designed to fit over or within the opening of a drain, and which are capable of being rolled.

Drain protectors are tools used to block sediment, collect contaminants, and filter water into a drain. Drain protectors generally have either tall diverters that surround a roadway drain opening blocking sediment from entering the drain or planar drain cover mats that are placed atop a floor drain to collect contaminants. The tall diverters have the issue of not being reinforced to prevent damage from vehicle traffic and planar drain covers have the issue of being clogged easily by debris and sediment.

This document describes a drain protector that is directed to solving at least some of the issues described above.

SUMMARY

A drain protector for blocking contaminants from entering a drain includes a flexible adsorbent pad having an insert receiving surface, an exposed surface, and an aperture. The insert receiving surface and the exposed surface are portions of a single surface on a single plane. The drain protector also includes a raised insert having a first surface, a second surface that is opposite the first surface, and an aperture. In some embodiments, at least a portion of second surface of the raised insert is positioned over the insert receiving surface of the flexible adsorbent pad, and the aperture of the raised insert is aligned with the aperture of the flexible adsorbent pad. In other embodiments, the raised insert is positioned within the aperture of the flexible adsorbent pad. The drain protector also includes a cover that serves as a reinforcement sheet and that is positioned over the exposed service of the flexible adsorbent pad and over the first surface of the raised insert. The drain protector is capable of being rolled into a substantially cylindrical shape.

In some embodiments, the aperture of the flexible adsorbent pad defines an inner perimeter of the flexible adsorbent pad, the aperture of the raised insert has an aperture that defines an inner perimeter of the raised insert, and the inner perimeter of the aperture of the flexible adsorbent pad is aligned with and adjacent to the inner perimeter of the aperture of the raised insert.

In some embodiments, the raised insert comprises an adsorbent material.

In some embodiments, the cover comprises a plastic or rubber mesh.

In some embodiments, the cover also includes an aperture that is aligned with the aperture of the flexible adsorbent mat and with the aperture of the raised insert, as well as an access door that is hingedly connected to the cover to open and close over the aperture of the cover.

In some embodiments, the drain protector also includes a base, the sheet includes an outer surface that is opposite a surface that includes the insert receiving surface and the exposed surface; and the base is connected to the outer surface of the sheet. Optionally, the base may be made of a fabric material, a reinforcing mesh material, or both.

Optionally, the flexible adsorbent pad is made of a combination of polyester material and polypropylene material.

Optionally, the drain protector includes anchoring members, such as one or grommets, magnets, and/or weights.

Optionally, the drain protector includes one or more seams that form alternating ridges on the exposed surface of the flexible adsorbent pad.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "approximately," when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower", or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed. The claims are intended to include all orientations of a device containing such components.

In addition, the figures are intended to show various optional features of various embodiments, but the invention is not limited to the illustrated embodiments. As will be apparent from the discussion below, the features of one figure may be combined with various features shown in other figure, and the claims are intended to include all such embodiments.

Figure 1:
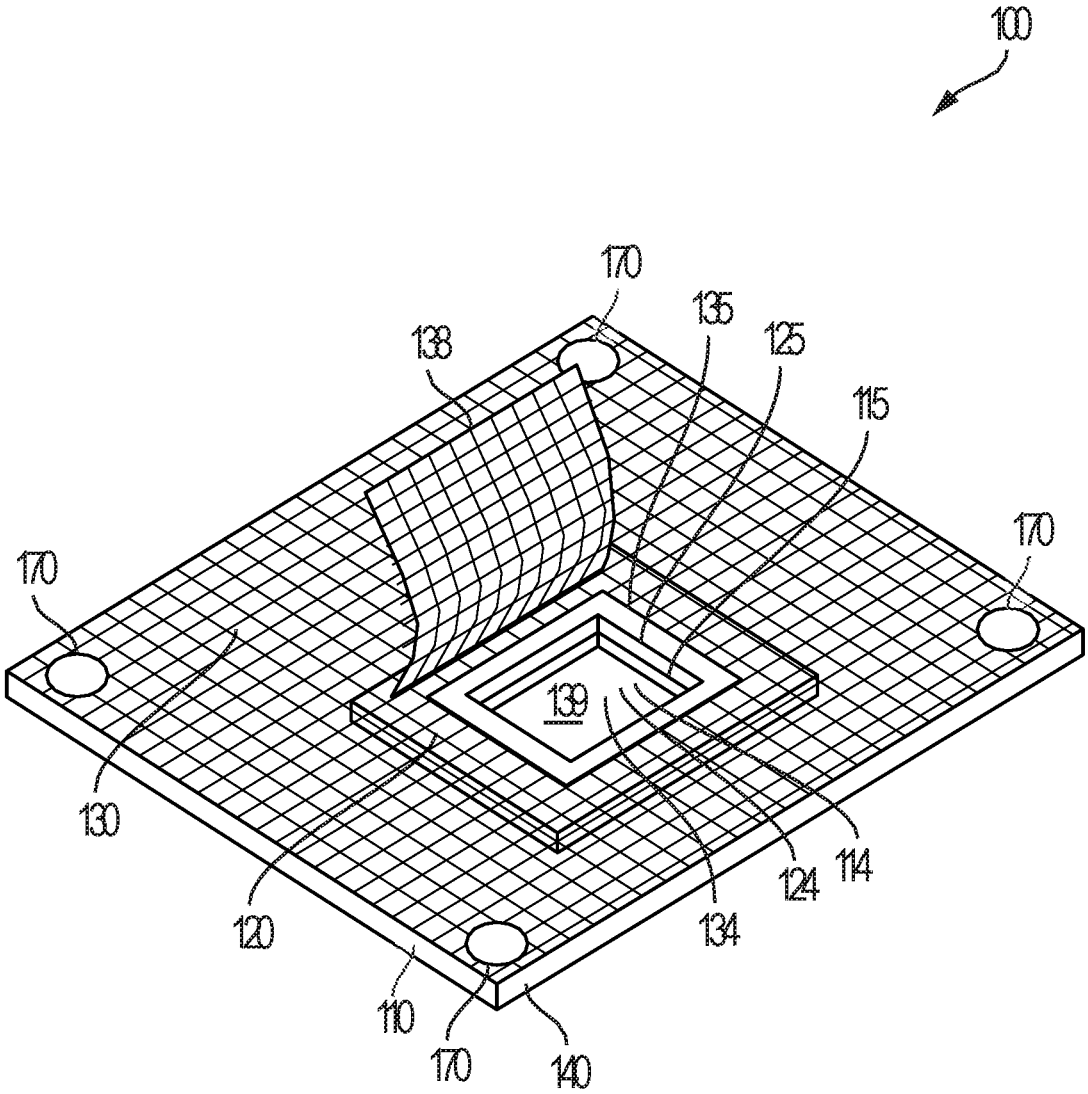
FIG. 1 is an isometric view of an example drain protector.
Figure 2:
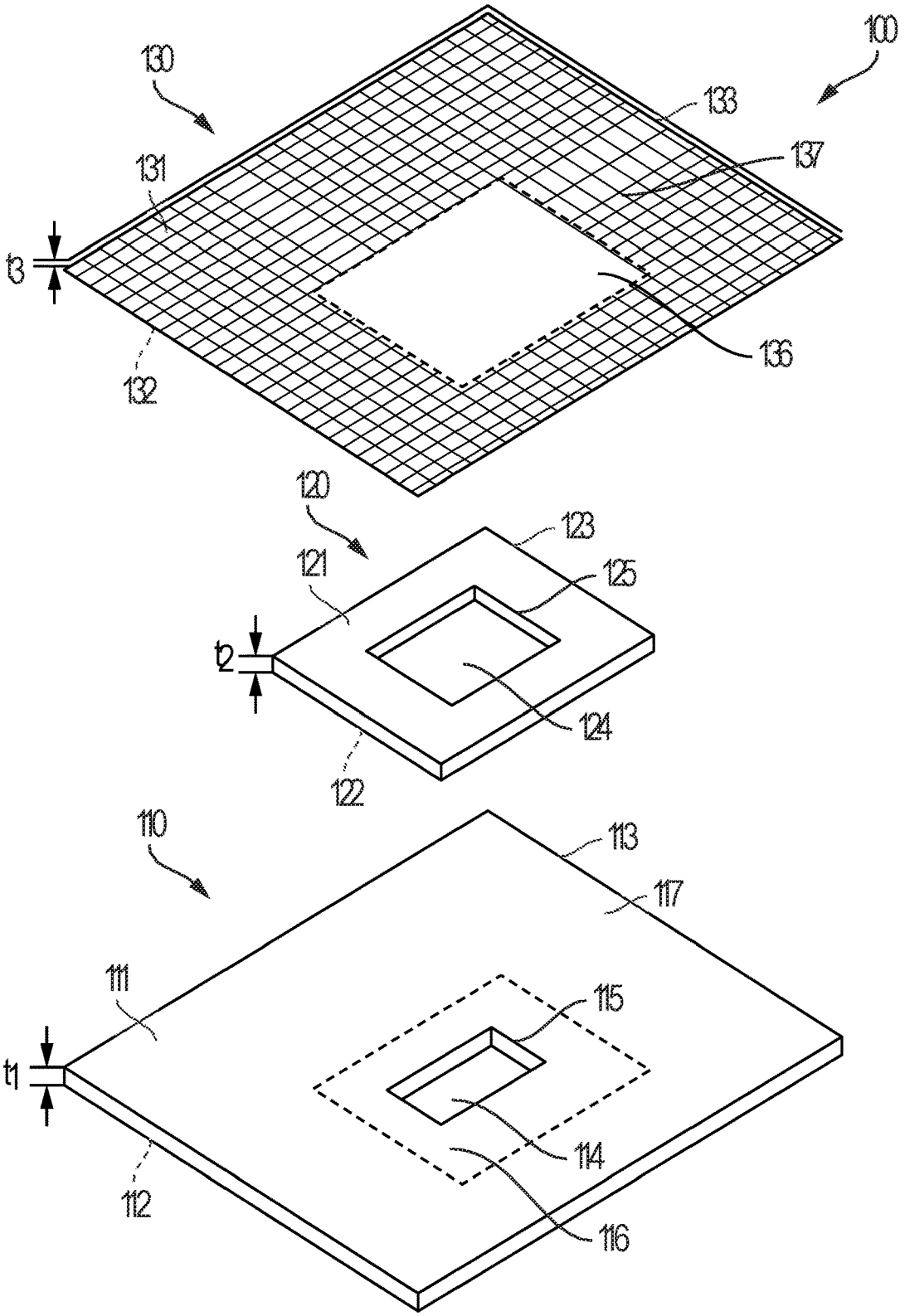
FIG. 2 is an expanded view of the example drain protector of FIG. 1, with the flexible door closed or missing.

FIG. 1 presents an isometric view of an example drain protector that is designed to fit over the grate that covers a drain, or within the opening of a drain and under the grate (if a grate is provided). FIG. 2 presents an expanded view of the example drain protector of FIG. 1, but without a door in the cover (which will be described below). A drain protector 100 may include a flexible adsorbent pad 110, a raised insert 120, and a cover 130.

The flexible adsorbent pad 110 and insert 120 may be made of absorbent or adsorbent materials so that that these elements block debris and sediment, collect contaminants, and filter water before any liquids enter a drain (not shown) that is positioned underneath the drain protector. (As used in this document, the term "adsorbent" interchangeably includes adsorbent or adsorbent materials unless exclusively stated as one or the other.) In some embodiments, the adsorbent material may be an oleophilic yet hydrophobic material, such as, e.g., polyester and/or polypropylene. For example, in one aspect, flexible adsorbent pad 110 and/or insert 120 may be formed of a combination of polyester material and polypropylene material, with the polyester material accounting for at least 75% of the material, and the polypropylene material accounting for substantially all of the remainder of the adsorbent material.

The drain that the drain protector 100 will cover may be an interior drain, such as a floor drain or manufacturing catch basin drain, or may be an exterior drain, such as a parking lot storm-water inlet, a road gulley storm-water inlet, or the like. Strict municipality regulations require construction sites to prevent sediment from entering nearby storm-water drains. The drain protector 100 may be placed directly over a drain inlet to prevent sediments and contaminants from entering the drain. Common debris forms are rocks, leaves, branches, trash, or the like. Common sediment forms are solid residues from liquid solutions such as silt or the like. Common contaminants are hydrocarbons (e.g., fuel, oil, or the like), nitrogen, phosphorous, organic matter, heavy metals, antibiotics, pathogens, and other toxic chemicals. For example, contaminants may be found in manufacturing or laboratory environments. To ensure the drain protector 100 remains in place during use, temporary weights, anchors, magnets, clips, compression fittings, cable ties (e.g., wire ties, zip ties), or the like may be used as will be described in more detail below.

The flexible adsorbent pad 110 may be in the form of a mat, pad, or the like. The flexible adsorbent pad 110 may be an adsorbent mat that blocks sediments, collects contaminants, and filters water. The flexible adsorbent pad 110 may be formed of a flexible material having a thickness $t_1$ capable of being rolled. The flexible adsorbent pad 110 may be a single layer of material, or multiple payers of material. The flexible adsorbent pad 110 may have any one of many different thicknesses $t_1$ for different applications, such as a flexible adsorbent pad 110 for an interior drain protector 100 may have a smaller thickness $t_1$ than the thickness $t_1$ of another flexible adsorbent pad 110 for an exterior drain protector 100. The flexible adsorbent pad 110 may have a first (e.g., inner) surface 111 on the top side of the flexible adsorbent pad, a second (e.g., outer) surface 112 on the bottom side of the flexible adsorbent pad, and an outer perimeter 113.

The flexible adsorbent pad 110 may also include an aperture 114 within the outer perimeter 113, in a central area of the flexible adsorbent pad 110. The aperture 114 defines an inner perimeter 115. The inner surface 111 of the flexible adsorbent pad 110 may define a first, insert receiving portion 116 and a second, exposed portion 117. The insert receiving portion and the exposed portion are along a single plane and form components of one side of the flexible adsorbent pad 110. The first portion 116 of the first surface 111 may receive and contact a surface of the insert 120 as will be described in more detail below. The second portion 117 of the inner surface 111 may be capable of contacting a portion of the surface of the cover 130 and thus be partially exposed to the environment, as will be described in more detail below. Alternatively, the raised insert 120 may fit fully within the aperture 114 of the flexible adsorbent pad so that the outer perimeter of the raised insert 120 aligns with the inner perimeter (aperture 114) of the flexible adsorbent pad.

The raised insert 120 may be a berm that is also made of an adsorbent sheet having one or more layers in the form of a mat, pad, or the like. The insert 120 may be an adsorbent mat that blocks sediments, collects contaminants, and filters water. The insert 120 may be formed of a flexible material having a thickness $t_2$ capable of being rolled. The insert 120 may have different thicknesses $t_2$ for different applications, such as insert 120 for an interior drain protector 100 may have a smaller thickness $t_2$ than the thickness $t_2$ of an insert 120 for an exterior drain protector 100. Likewise, the insert 120 may have a different thickness $t_2$ than thickness $t_1$ of the flexible adsorbent pad 110 for different applications, such the thickness $t_2$ may be larger than the thickness $t_1$ of the flexible adsorbent pad 110 so as to capture sediment in storm-water before the storm-water reaches the drain. The thickness $t_2$ of the insert 120 may create a speed bump effect which may slow water and allow sediment to settle before going down the drain (not shown).

The material of the insert 120 may be the same as the material of the flexible adsorbent pad 110 or the materials of the flexible adsorbent pad 110 and insert 120 may be different. The insert 120 may have a first surface 121 on the top of the insert 120, a second surface 122 on the bottom of the insert 120, and an outer perimeter 123.

The insert 120 may also include an aperture 124 within the outer perimeter 123. The aperture 124 defines an inner perimeter 125. The second surface 122 of the insert 120 may be capable of contacting the first portion 116 of the inner surface 111 of the flexible adsorbent pad 110. The insert 120 may be placed adjacent the flexible adsorbent pad 110 such that the inner perimeter 125 of the aperture 124 may be sized the same as and aligned with the inner perimeter 115 of the aperture 114 of the flexible adsorbent pad 110. Alternatively, it is also contemplated that the apertures 114 and 124 may not be sized the same or aligned together, although and may be merely concentric so that aperture 114 has dimensions larger than those of aperture 124, or vice versa, so that the smaller of the two apertures is positioned in the center of, and remains fully within, the space of the outer aperture. The aligned apertures 114 and 124 allow uncontaminated fluids to be directly poured into a floor drain (not shown) without the need to pass through the filtering flexible adsorbent pad 110 or insert 120.

The cover 130 may be a reinforcement sheet in the form of a mat, pad, or the like. The cover 130 may be a mesh material capable of being attached to the flexible adsorbent pad 110 as will be described in more detail below. The cover 130 may be a mesh material capable of reinforcing the flexible adsorbent pad 110 while remaining flexible for rolling of the drain protector 100 as will be described in more detail below. The openings of the mesh cover 130 may be sized to allow uncontaminated fluids to be poured through to the aligned apertures 114 and 124 below.

The cover 130 may be formed of a flexible material having a thickness $t_3$ capable of being rolled. For example, the cover 130 may be made of flexible plastic, rubber, or another material that is more durable to foot traffic than is the material of the flexible adsorbent pad 110 or the raised insert 120. The cover 130 may have any of various different thicknesses $t_3$ for different applications, such as cover 130 for an interior drain protector 100, which may be stepped on by pedestrians, may have a smaller thickness $t_3$ than the thickness $t_3$ of a cover 130 for an exterior drain protector 100, which may be driven over by vehicles.

The cover 130 may have an outer surface 131 on the top side of the cover 130, an inner surface 132 on the bottom side of the cover 130, and an outer perimeter 133. The inner surface 132 of the cover 130 may define a first portion 136 and a second portion 137. The first portion 136 of the inner surface 132 may be capable of contacting a first surface 121 on the top of the insert 120. The first surface 121 of the raised insert 120 may be adjacent to the first portion 136 of the inner surface 132 of the cover 130. The second portion 137 of the inner surface 132 may be capable of contacting a second portion 117 of the inner surface 111 of the flexible adsorbent pad 110. The second portion 117 of the inner surface 111 of the flexible adsorbent pad 110 may be connected to the second portion 137 of the inner surface 132 of the cover 130.

Figure 3:
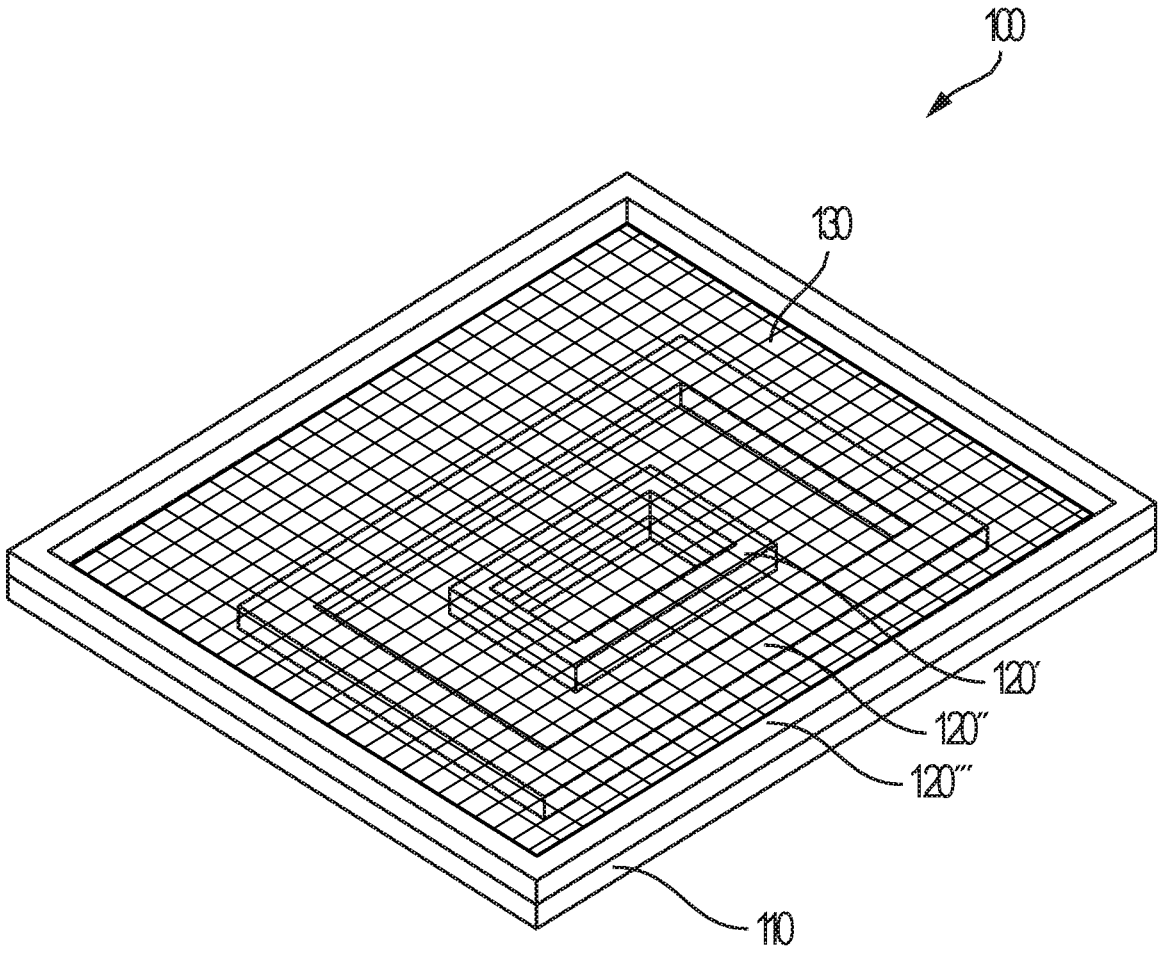
FIG. 3 is an isometric view of an example drain protector having multiple inserts.

The drain protector 100 may have a single raised insert 120 or multiple raised inserts. For example, FIG. 3 presents a drain protector 100 having an inner insert 120', a middle insert 120", and an outer insert 120'". The nested inserts 120', 120", and 120'" may have the same thickness $t_2$ or may have varying thicknesses. For example, the thickness of the inner insert 120' may be larger than the thickness of the middle insert 120", which also may be larger than the thickness of the outer insert 120'". Each incremental thickness may provide a speed bump effect to block sediments, collects contaminants, and filters water before the fluid reaches the drain (not shown).

Figure 4:
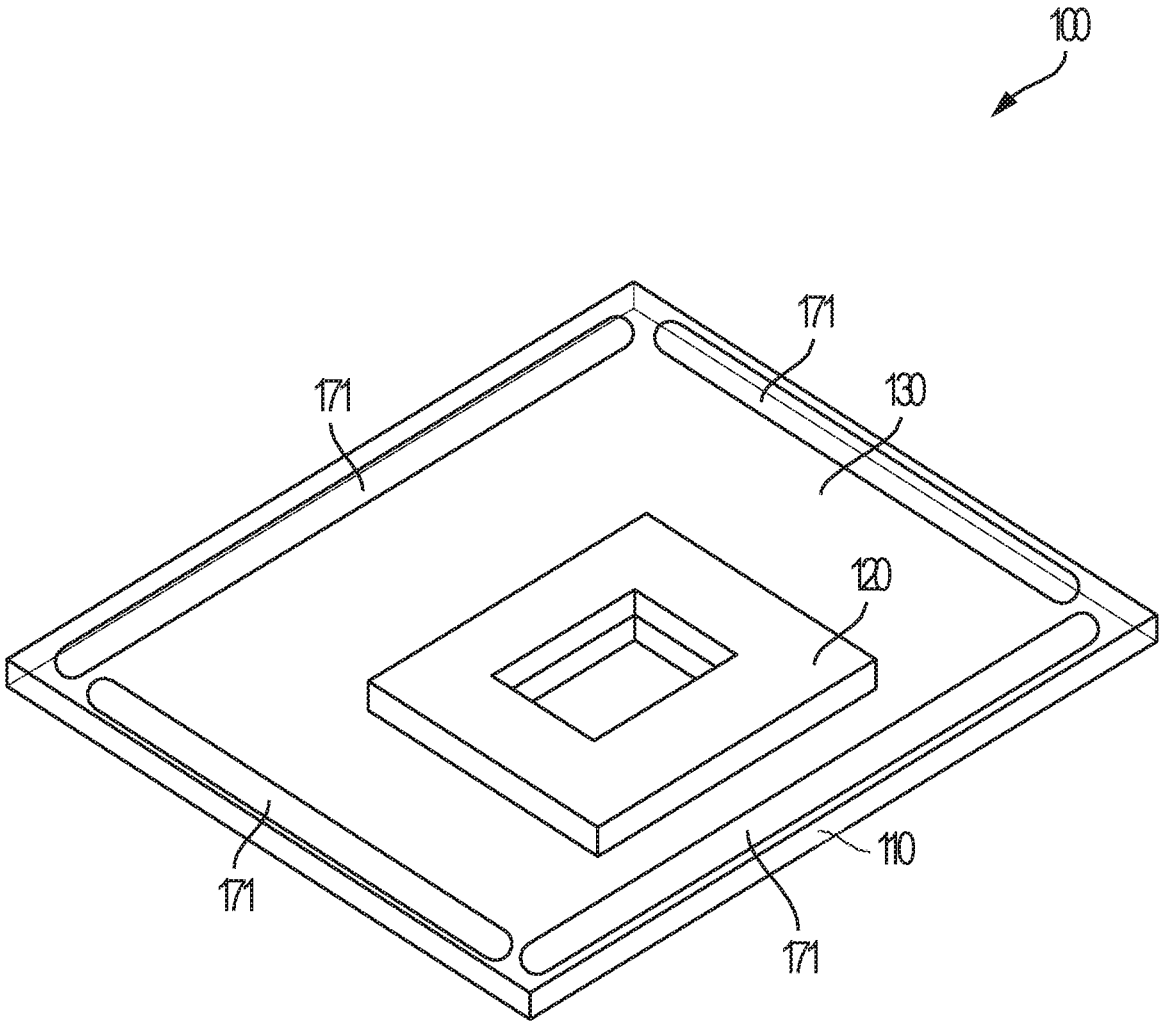
FIG. 4 is an isometric view of an example drain protector having elongated anchoring elements along its perimeter.

Optionally, as shown in FIGS. 2 and 4, the cover 130 may be a sheet that fully covers the flexible adsorbent pad 110. Alternatively, as shown in FIG. 1, the drain protector 100 may have an opening with flexible access door 138 that is positioned to be placed directly over a drain opening to provide a sampling port 139. The sampling port 139 allows a sampling vessel (not shown) to be submerged into a drain (not shown) for testing the filtering effectiveness of the drain protector 100. For example, FIG. 4 presents an isometric view of an example drain protector 100 having an access door 138. The access door 138 may be an additional mesh cover portion hinged or slidably disposed or removably disposed adjacent an aperture 134 of the cover 110. The aperture 134 of the cover 110 defines an inner perimeter 135 of the cover 110 and may be sized substantially the same as and aligned with the inner perimeter 125 of the aperture 124 of the raised insert 120 and the inner perimeter 115 of the aperture 114 of the flexible adsorbent pad 110. The aligned apertures 114, 124, and 134 may form the sampling port 139. The access door 138 may be sized larger than the aperture 134 of the cover 130 so as to ensure debris does not enter the drain (not shown).

Returning to FIG. 1, in some embodiments a bottom layer 140 may be connected to the outer surface 112 of the flexible adsorbent pad 110. The bottom layer 140 may or may not cover the aperture 114 of the flexible adsorbent pad 110.

Optionally, the bottom layer 140 may be a breathable, flexible fabric with pores or other openings sized to allow uncontaminated fluids to be pass through to the drain while keeping sediments from passing through. The fabric could be close-knit fabric made from nylon. An example of a nylon fabric is OIL SHARK™ fabric manufactured by Cerex Advanced Fabrics and described in U.S. Pat. No. 8,882,399, the disclosure of which is incorporated by reference. Other fabrics may be employed to filter other contaminate types. For example, a combination of a fabric filtering sediment, a fabric filtering heavy metals, and a fabric filtering hydrocarbons may be layered below the flexible adsorbent pad 110 to provide a range of filtering applications while still allowing uncontaminated fluids to be pass through to the drain (not shown).

In other embodiments, the bottom layer 140 may be a flexible base that is connected to the outer surface 112 of the flexible adsorbent pad 110. The outer surface 112 is opposite the surface that includes the insert receiving surface and the exposed portion. The base may be a reinforcement sheet in the form of a mat, pad, or the like. The base may be a mesh material similar to the mesh material of the cover 130 or may be fabricated with different material or opening sizes. The base may be an additional mesh sheet separate from the upper mesh sheet cover 130 or may be integral with the upper mesh sheet cover 130 (i.e., the cover 130 and base may be a folded sheet (not shown) of mesh material surrounding the flexible adsorbent pad 110 and insert 120). The base may be permanently connected to the flexible adsorbent pad 110 or may be releasably connected to the flexible adsorbent pad 110 to allow access to the aperture 114 as will be described below.

Returning to FIG. 1, the drain protector 100 may include one or more anchoring elements 170 located adjacent the outer perimeter 103 of the drain protector 100. Anchoring elements 170 allow for temporary anchoring of a drain protector 100 above or adjacent a drain (not shown). The anchoring elements 170 may be grommets to which tie-down elements (such as cords) may be attached, weights that help hold the drain protector in place, magnets, or other anchoring structures. A single anchoring element 170 (or multiple such elements) may be placed adjacent each corner of an example rectangular drain protector 100 and/or at a midsection of each edge (not shown). Small localized anchoring elements 170 may be employed as shown in FIG. 1, or elongated perimeter anchoring 171 may be employed adjacent the outer perimeter 103 of the drain protector 100 as shown in FIG. 4. For example, FIG. 10 presents an isometric view of an example drain protector 100 employing elongated perimeter magnets as anchoring elements 171'.

Other forms of anchoring are also contemplated. For example, temporary weights may be placed along the perimeter 110 of the drain protector 100 for temporary anchoring.

Figure 5:
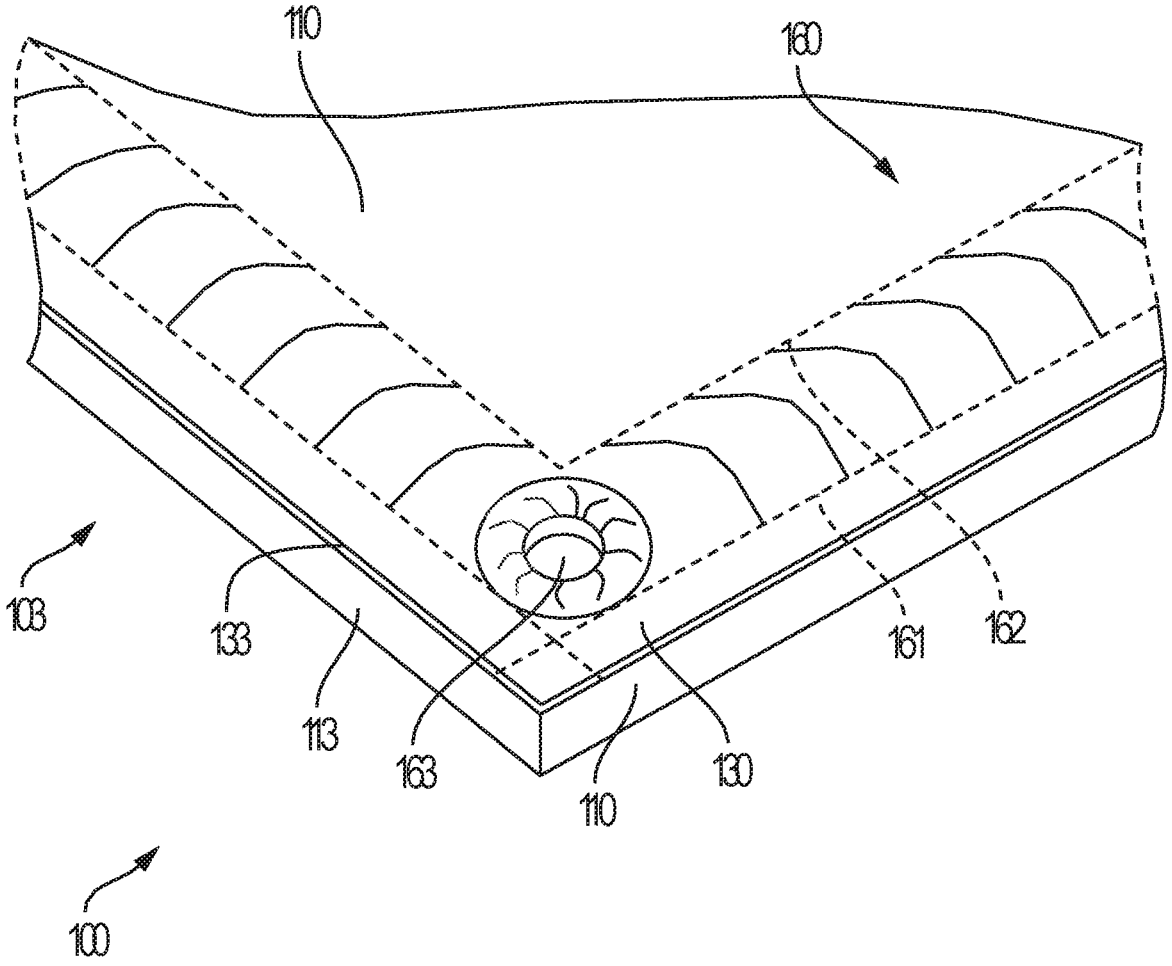
FIG. 5 is a close-up view of an example corner of the drain protector of FIG. 1.

FIG. 5 presents a detailed view of an example corner of the drain protector 100 of FIG. 1. The cover 130 is connected to the flexible adsorbent pad 110 along the outer perimeters 113, 133. Methods of attachment may be heat welding, riveting, sewing or the like. Seams 161 and 162 are capable of forming an outer ring 160 adjacent the outer perimeter 103 of the drain protector 100. The outer ring 160 has a thickness that is sufficient to make it capable of creating a berm to block large debris (i.e., trash, leafs, or sticks) and sediment from passing over the drain protector 100 when positioned in an environment. The seams 161, 162 will result in alternating relatively higher portions (ridges) and relatively lower portions (valleys) on the top of the flexible adsorbent pad 110. These ridges and valleys can promote turbulence circulation of fluid as it passes over and through the adsorbent pad 110, this increasing its effectiveness in filtering the fluid. To further increase this turbulence, additional seams may be positioned between the perimeter 103 and aperture 120 of the flexible adsorbent pad.

Anchoring structures such as grommet 163 may be located adjacent the outer perimeter 103' of the drain protector 100. Grommets 163 (when included) may allow for permanent or temporary anchoring of a drain protector 100 above or adjacent a drain (not shown). For example, anchor bolts may be connected through the grommets 163 for a permanent anchoring or stakes may be placed through the grommets 163 for temporary anchoring. A single grommet 163 may be placed adjacent each corner of an example rectangular drain protector 100 and/or at a midsection of each edge (not shown). Likewise, two or more grommets 163 may be placed adjacent each corner for multidirectional anchoring methods.

The flexible adsorbent pad 110, insert 120, and cover 130 may have various shapes and sizes. The flexible adsorbent pad 110 and cover 130 may have the identical size or may have different shapes and/or sizes. Any or all of the flexible adsorbent pad, raised insert, and apertures may be rectangular, round, oblong, or otherwise shaped.

Figure 6:
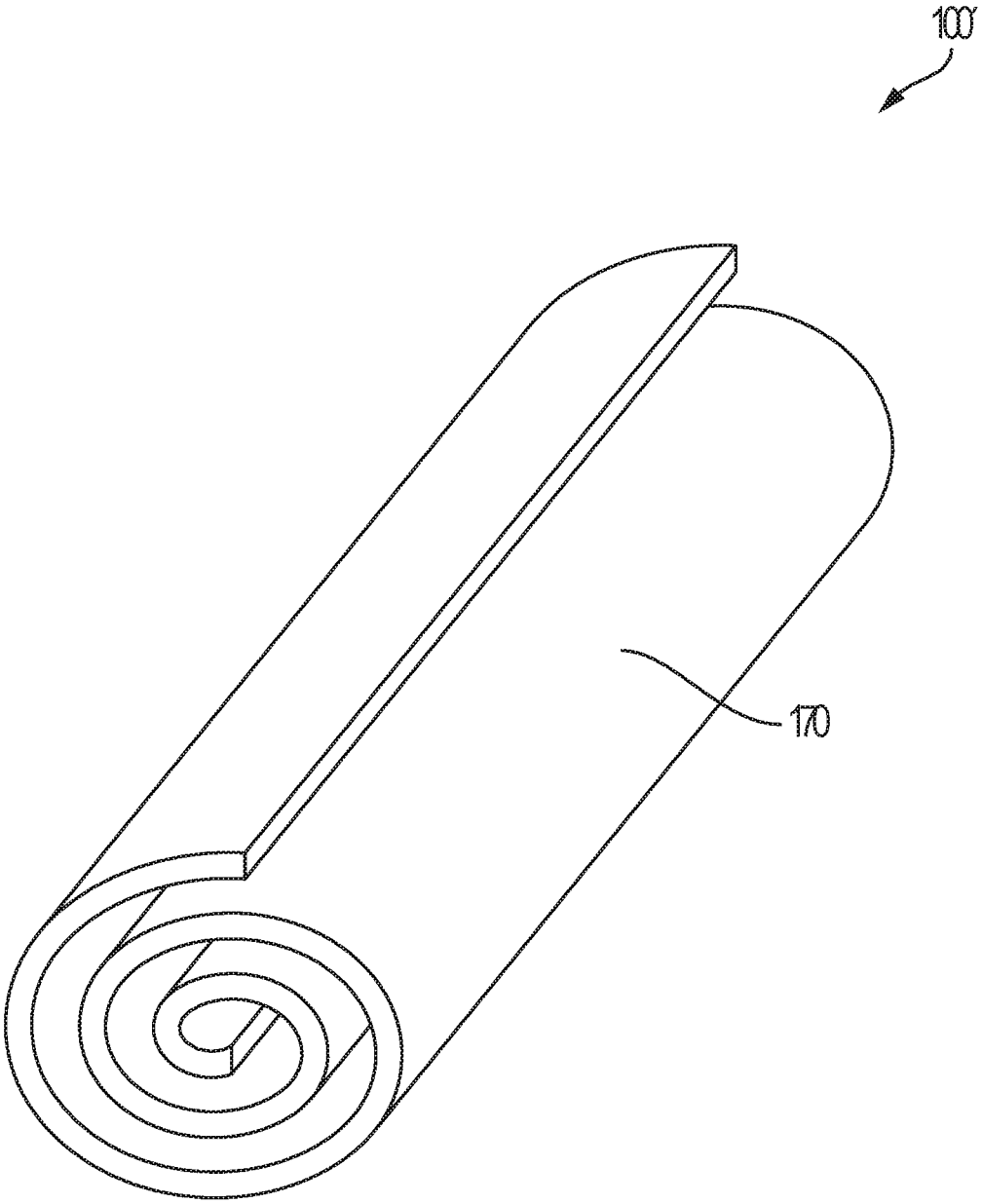
FIG. 6 is a shipping view of a drain protector.

FIG. 6 presents a shipping view of the drain protector 100. A drain protector may be rolled to a compact form 170 having a substantially cylindrical shape. The compact size of the rolled drain protector 100 may allow for improved shipping methods. For example, a drain protector 100 having the length×width×height dimensions 4 ft×4 ft×2 in exceeds the current United States Postal Service (USPS) shipping dimensions, but may be rolled into a compact rolled drain protector 100, which may be shipped by the USPS in an allowable shipping container having a more convenient 4 ft×1 ft×1 ft shipping dimension. Optionally, the raised insert (120 in previous figures) may be removed before rolling, or it may be fixed to the flexible adsorbent pad and rolled along with the pad.

Other drain protector 100 applications are contemplated, such as L-shaped drain protectors placed over and against roadway gulley storm-water drains (not shown), over waste-water (e.g., sewage) man-hole covers, waterpark catch basins, or the like.

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. A drain protector for blocking contaminants from entering a drain, the drain protector comprising:
- a flexible adsorbent pad having an aperture;
- a raised insert having an aperture, wherein
  - the aperture of the raised insert is positioned over the aperture of the flexible adsorbent pad; and
- a cover that is positioned over the flexible adsorbent pad and over the first surface of the raised insert, wherein the cover comprises:
  - an aperture that is positioned over the aperture of the flexible adsorbent pad and the aperture of the raised insert, and
  - an access door that is connected to the cover to open and close over the aperture of the cover,
  - wherein the drain protector is capable of being rolled into a substantially cylindrical shape.

2. The drain protector of claim 1, wherein:
- the aperture of the flexible adsorbent pad defines an inner perimeter of the flexible adsorbent pad;
- the aperture of the raised insert has an aperture that defines an inner perimeter of the raised insert; and
- the inner perimeter of the aperture of the flexible adsorbent pad is aligned with and adjacent to the inner perimeter of the aperture of the raised insert.

3. The drain protector of claim 1, wherein the raised insert comprises an adsorbent material.

4. The drain protector of claim 1, wherein the cover comprises a plastic or rubber mesh.

5. The drain protector of claim 1, further comprising a base, and wherein:
- the sheet includes an outer surface that is opposite a surface that includes the insert receiving surface and the exposed surface; and
- the base is connected to the outer surface of the sheet.

6. The drain protector of claim 5, wherein the base comprises a fabric material, a reinforcing mesh material, or both.

7. The drain protector of claim 1, wherein the flexible adsorbent pad comprises a combination of polyester material and polypropylene material.

8. The drain protector of claim 1, further comprising a plurality of anchoring members, each of which comprises a grommet, a magnet, a weight, or a combination of any of these.

9. The drain protector of claim 1, further comprising one or more seams that form alternating ridges on the exposed surface of the flexible adsorbent pad.

10. A drain protector for blocking contaminants from entering a drain, the drain protector comprising:
- a flexible adsorbent pad having an aperture;
- a raised insert having an outer perimeter and an aperture, wherein the raised insert is positioned within the aperture of the flexible adsorbent pad and the outer perimeter of the raised insert is aligned with an inner perimeter of the aperture of the flexible adsorbent pad; and
- a cover that is positioned over the exposed surface of the flexible adsorbent pad and over the first surface of the raised insert, wherein the cover comprises:
  - an aperture that is positioned over the aperture of the flexible adsorbent pad and the aperture of the raised insert, and
  - an access door that is connected to the cover to open and close over the aperture of the cover,
- wherein the drain protector is capable of being rolled into a substantially cylindrical shape.

11. The drain protector of claim 10, wherein the raised insert comprises an adsorbent material.

12. The drain protector of claim 10, wherein the cover comprises a plastic or rubber mesh.

13. The drain protector of claim 10, further comprising a base, and wherein:
- the sheet includes an outer surface that is opposite a surface that includes the insert receiving surface and the exposed surface; and
- the base is connected to the outer surface of the sheet.

14. The drain protector of claim 13, wherein the base comprises a fabric material, a reinforcing mesh material, or both.

15. The drain protector of claim 10, wherein the flexible adsorbent pad comprises a combination of polyester material and polypropylene material.

16. The drain protector of claim 10, further comprising a plurality of anchoring members, each of which comprises a grommet, a magnet, a weight, or a combination of any of these.

17. The drain protector of claim 10, further comprising one or more seams that form alternating ridges on the exposed surface of the flexible adsorbent pad.

* * * * *